US009184014B2

(12) United States Patent
Kubisa

(10) Patent No.: US 9,184,014 B2
(45) Date of Patent: Nov. 10, 2015

(54) ELECTRICAL OPERATOR FOR CIRCUIT BREAKER AND METHOD THEREOF

(71) Applicant: General Electric Company, Schenectady, NY (US)

(72) Inventor: Artur Wincenty Kubisa, Slaskie (PL)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 184 days.

(21) Appl. No.: 13/756,993

(22) Filed: Feb. 1, 2013

(65) Prior Publication Data

US 2014/0218139 A1 Aug. 7, 2014

(51) Int. Cl.

| | |
|---|---|
| ***H01H 77/06*** | (2006.01) |
| ***H01H 3/30*** | (2006.01) |
| ***H01H 71/68*** | (2006.01) |
| *H01H 3/28* | (2006.01) |
| *H01H 71/66* | (2006.01) |
| *H01H 83/20* | (2006.01) |

(52) U.S. Cl.

CPC ..... *H01H 77/06* (2013.01); *H01H 3/3015* (2013.01); *H01H 3/3021* (2013.01); *H01H 71/68* (2013.01); *H01H 3/28* (2013.01); *H01H 2071/665* (2013.01); *H01H 2083/205* (2013.01)

(58) Field of Classification Search

CPC ... H01H 3/3015; H01H 3/3021; H01H 71/68; H01H 77/06; H01H 3/28; H01H 2071/665; H01H 2083/205; H01H 13/568; H01H 27/007

See application file for complete search history.

(56) References Cited

U.S. PATENT DOCUMENTS

| | | | | |
|---|---|---|---|---|
| 2,960,186 | A | 11/1960 | Andre | |
| 3,525,956 | A | 8/1970 | Poschman | |
| 3,915,273 | A * | 10/1975 | Loschengruber | 192/135 |
| 4,553,115 | A | 11/1985 | Grunert et al. | |
| 4,642,726 | A | 2/1987 | Matsko et al. | |
| 5,504,290 | A | 4/1996 | Baginski et al. | |
| 5,512,869 | A * | 4/1996 | Thuries | 335/177 |
| 5,905,240 | A | 5/1999 | Robarge et al. | |
| 6,107,702 | A | 8/2000 | Bilac et al. | |
| 6,423,917 | B2 | 7/2002 | Narayanan et al. | |
| 6,590,481 | B2 | 7/2003 | Turner et al. | |
| 6,770,832 | B2 | 8/2004 | Marchand et al. | |
| 8,134,437 | B2 | 3/2012 | Brooks | |
| 8,912,870 | B2 * | 12/2014 | Marushima et al. | 335/190 |
| 2001/0014027 | A1 * | 8/2001 | Mori et al. | 363/21.07 |

FOREIGN PATENT DOCUMENTS

| | | | |
|---|---|---|---|
| DE | 102007059017 | * | 6/2009 |
| EP | 0424280 | A1 | 4/1991 |
| EP | 0427641 | A1 | 5/1991 |
| EP | 0015228 | A1 * | 5/2005 |

(Continued)

OTHER PUBLICATIONS

European Search Report and Opinion issued in connection with corresponding EP Application No. 14153550.0 on May 26, 2014.

(Continued)

*Primary Examiner* — Mohamad Musleh

(74) *Attorney, Agent, or Firm* — GE Global Patent Operation; Stephen G. Midgley

(57) ABSTRACT

An electrical operator for a circuit breaker includes a carriage moving assembly and a solenoid having a reciprocating plunger. The plunger is configured to engage with the carriage moving assembly in response to a pulsating current.

20 Claims, 9 Drawing Sheets

(56) References Cited

FOREIGN PATENT DOCUMENTS

| | | | | |
|---|---|---|---|---|
| EP | 1533826 | A1 | * | 5/2005 |
| GB | 230411 | A | * | 6/1925 |
| GB | 776025 | A | * | 5/1957 |
| GB | 2185631 | A | | 7/1987 |
| JP | 03008234 | A | * | 1/1991 |
| WO | WO 2007010608 | A1 | * | 1/2007 |
| WO | 2008008446 | A2 | | 1/2008 |

OTHER PUBLICATIONS

So-Nam Yun et all, "High speed solenoid actuator for high-voltage circuit breaker"; 2011 11th International Conference on Control, Automation and Systems; Oct. 26-29, 2011 in KINTEX, Gyeonggi-do, Korea; 5 pages.

http://www.electronics-tutorials.ws/io/io$_{13}$ 6.html; "Linear Solenoid"; printed Feb. 1, 2013; 4 pages.

* cited by examiner

ELECTRICAL OPERATOR FOR CIRCUIT BREAKER AND METHOD THEREOF

BACKGROUND OF THE INVENTION

The subject matter disclosed herein relates to an electrical operator for a circuit breaker.

Circuit breakers employ pairs of separable contacts, an operating mechanism, and releases. The operating mechanism within the circuit breaker rapidly drives the contacts to their open positions upon the occurrence of an overcurrent condition. An external operating handle or toggle is employed to move the contacts between open and closed conditions usually to energize associated electrical equipment.

When such a circuit breaker is located remotely from the associated equipment, an electrical operator can be disposed on the circuit breaker. The electrical operator engages the operating handle of the circuit breaker and moves the handle under driving force provided by a remotely-switched electric motor. The electrical operator provides a storage system of mechanical energy accumulated for a rapid opening or closing operation of the circuit breaker, and provides high energy in a short time. The energy storage system of the electrical operator is charged via the motor, which includes a rotatable shaft that drives a gear set. The last stage of the gear set engages with an eccentric cam that pushes a charging lever with a frequency corresponding to the angular velocity of the last stage of the gears. The charging lever moves a tensioning cam to drive a spring loaded carriage that includes a handle opening through which the handle from the circuit breaker extends. Stored energy from the springs is released to quickly switch the circuit breaker.

BRIEF DESCRIPTION OF THE INVENTION

According to one aspect of the invention, an electrical operator for a circuit breaker includes a carriage moving assembly and a solenoid having a reciprocating plunger. The plunger is configured to engage with the carriage moving assembly in response to a pulsating current.

According to another aspect of the invention, an electrical operator for a circuit breaker includes a carriage system engageable with a breaker toggle of a circuit breaker, a carriage moving assembly arranged to move the carriage system, and a solenoid including a reciprocating plunger arranged to engage with the carriage moving assembly in response to a pulsating current.

According to yet another aspect of the invention, a method of operating an electrical operator for a circuit breaker includes closing a switch, delivering a pulsating current to a solenoid, reciprocating a plunger of the solenoid at a frequency of the pulsating current, engaging the plunger with a carriage moving assembly, the carriage moving assembly moving a carriage system to compress energy storage springs, and latching the carriage system when the operator is fully charged.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
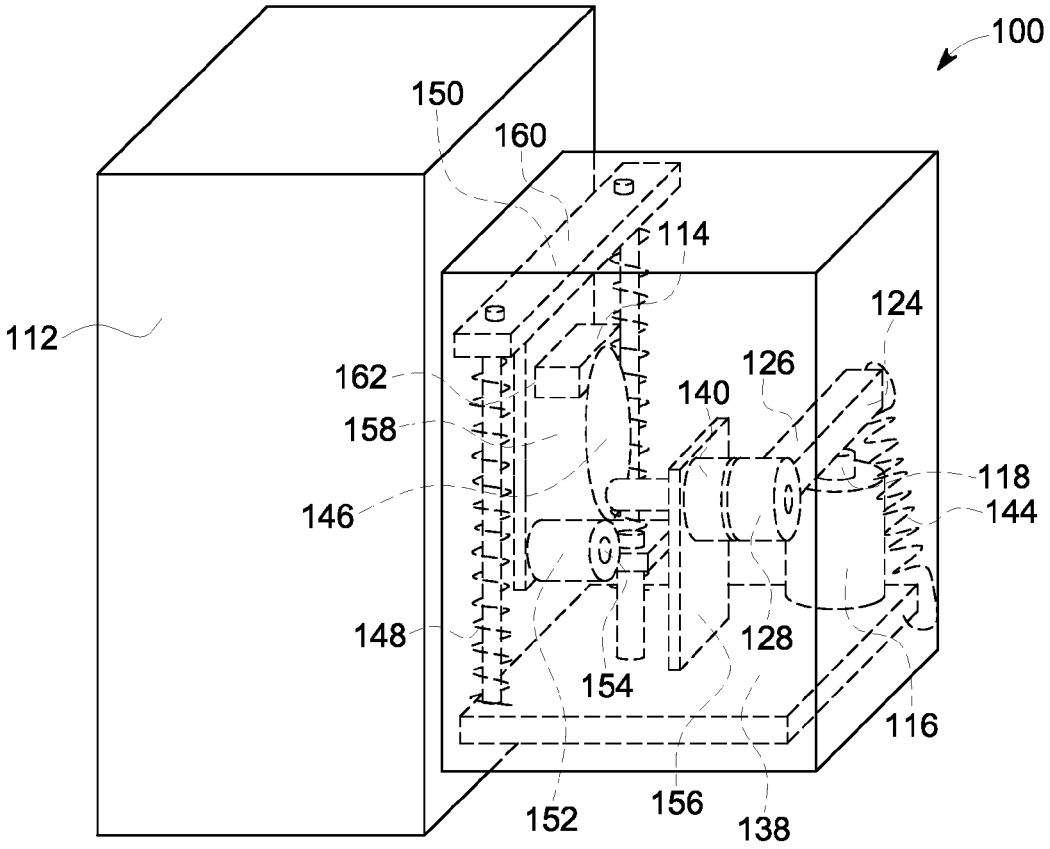
FIG. 1 is a side perspective diagram of an exemplary embodiment of an electrical operator employing an exemplary solenoid.

FIG. 1 illustrates an exemplary embodiment of an electrical operator 100. The electrical operator 100 shown in FIG. 1 is positioned on an exterior of a circuit breaker 112, the circuit breaker 112 having a breaker toggle 114 as shown. Movement of the toggle 114 is capable of opening and closing contacts contained within the circuit breaker 112. The circuit breaker 112 is outfitted with the electrical operator 100 to enable remote switching of the contacts. An exemplary embodiment of the electrical operator 100 for a circuit breaker 112 replaces a motor and gear set of a typical operator with a solenoid 116, such as a linear solenoid.

Figure 2:
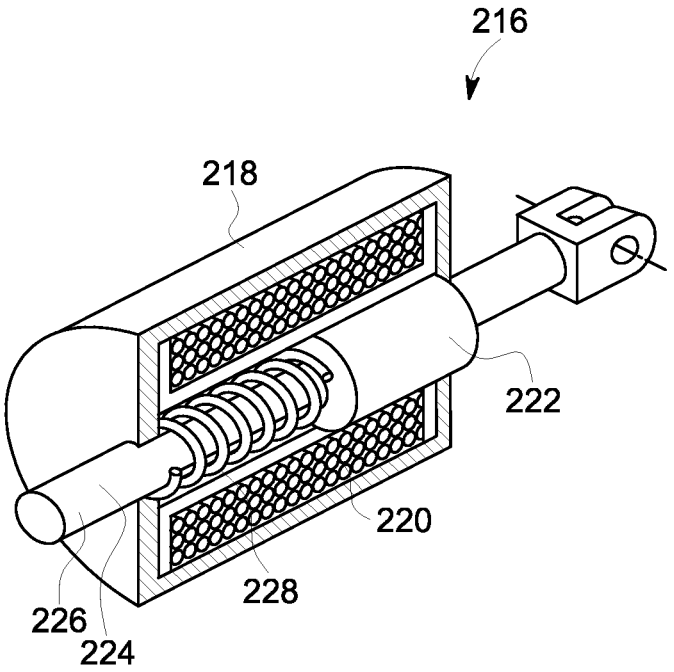
FIG. 2 is a side cross-sectional view of an exemplary embodiment of a solenoid for use with the electrical operator of FIG. 1.
Figure 3:
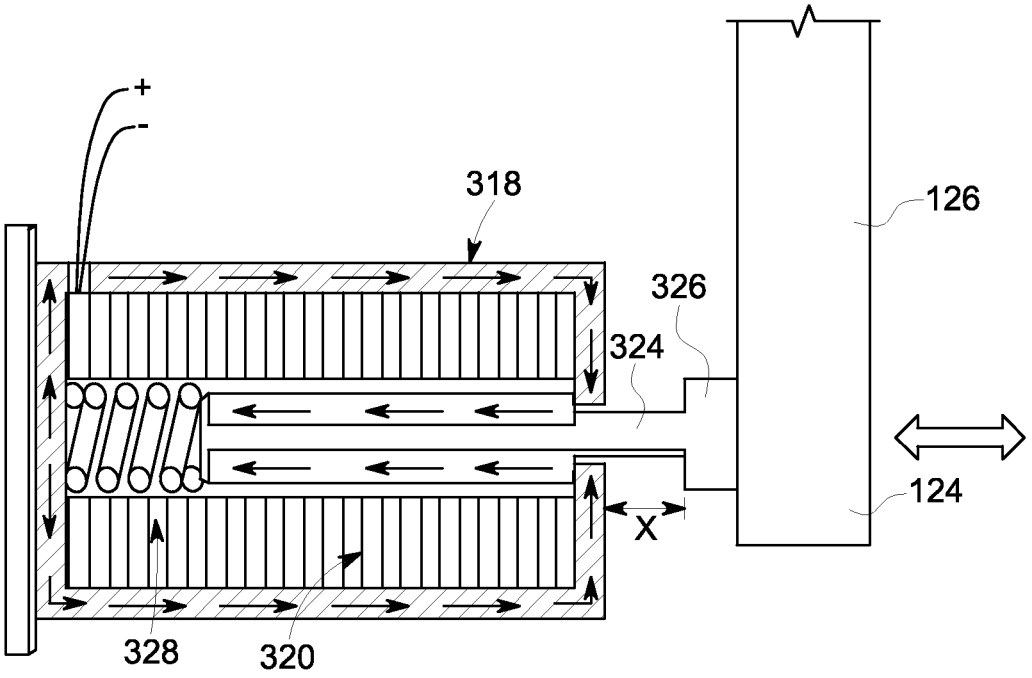
FIG. 3 is a perspective partial cross-sectional view of another exemplary embodiment of a solenoid for use with the electrical operator of FIG. 1.

Exemplary embodiments of a solenoid 116 are shown in FIGS. 2 and 3 as solenoids 216 and 316, respectively. With reference to FIG. 2, the solenoid 216 includes a case 218 that surrounds a coil winding 220. When an electrical current is passed through the coil winding 220, an internal section 222 of a solenoid plunger 224 is attracted closer towards the center of the coil 220 by the magnetic flux. The attraction of the internal section 222 of the plunger 224 towards the center of the coil 220 linearly moves an opposite external portion 226 of the plunger 224 towards a free end portion 124 of a charging lever 126 (FIG. 1). The solenoid 216 may further include an internal spring 228 where the internal section 222 of the plunger 224 compresses the internal spring 228 within the coil 220, such that when electrical current is not passed through the coil 220, the internal spring 228 forces the internal section 222 of the plunger 224 away from the center of the coil 220, and the external portion 226 of the plunger 224 away from the free end portion 124 of the charging lever 126.

The solenoid 316 of FIG. 3 is similar to the solenoid 216 of FIG. 2 in that it also includes a case 318, coil 320, and plunger 324, however the external portion 326 of the solenoid plunger 324 is drawn towards the center of the coil 320 in a direction away from the free end portion 124 of the charging lever 126 compressing an internal spring 328 when the solenoid 316 receives a pulse. The internal spring 328 subsequently returns the external portion 326 of the solenoid plunger 324 towards the free end 124 of the charging lever 126.

While particular embodiments of solenoids 216, 316 have been illustrated in FIGS. 2 and 3, other modifications of the solenoid 116 are within the scope of these embodiments. The solenoid 116 shown in FIG. 1 can be arranged internally to include an internal spring 228, 328 as shown in FIGS. 2 and 3, or alternatively or additionally can include an external spring, such as return spring 144, to return the plunger 118 into the solenoid 116. In the exemplary embodiments of the electrical operator 100, the solenoid 116 is powered with pulsating current, such that the solenoid plunger 118 reciprocates in a linear direction, such as along a longitudinal axis of the solenoid 116, and pushes the free end portion 124 of the charging lever 126 with frequency of pulsating current. The pulsating current employed in the exemplary embodiments described herein includes a pulsating direct current having a plurality of pulses for every charging operation, such that the plunger 118 reciprocates multiple times with respect to the solenoid 116 during a single charging operation, as will be further described below.

Figure 4:
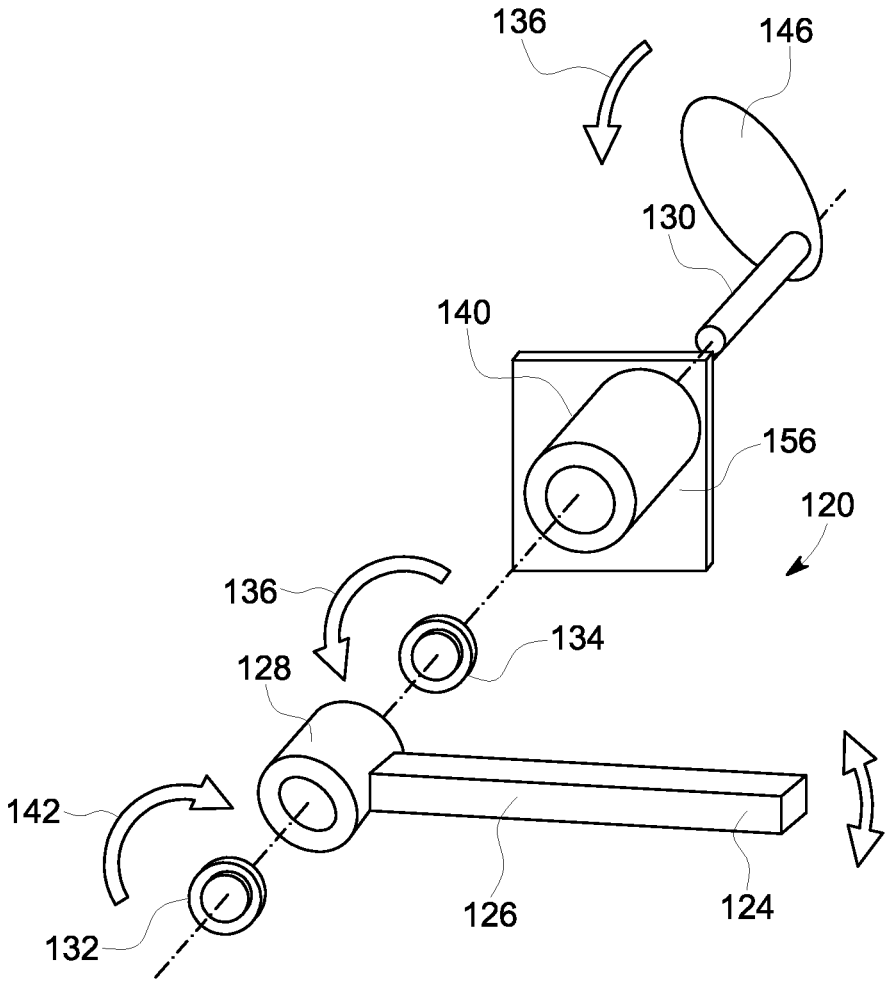
FIG. 4 is an exploded perspective view of an exemplary charging lever and exemplary tensioning cam of the electrical operator of FIG. 1.
Figure 5:
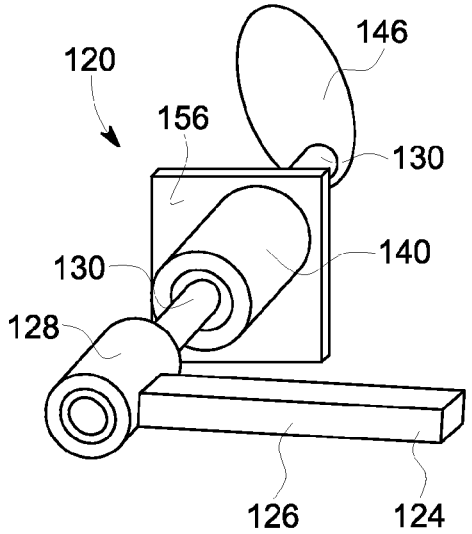
FIG. 5 is a perspective view of the charging lever and tensioning cam of FIG. 4 assembled together.

FIGS. 4 and 5 depict an exemplary embodiment of a carriage moving assembly 120. As shown in FIG. 4, a pivoting end 128 of the charging lever 126 is mounted on the main shaft 130 via a one direction clutch 132, so that the charging lever 126 can rotate freely in one rotational direction only, illustrated as direction 142. In an opposite rotational direction 136, the charging lever 126 rotates together with the main shaft 130 by one direction clutch 134. The main shaft 130 extends through a bush 140 which is supported by an extension plate 156 extending from a side of the housing 138 of the operator 100. The side of the housing 138 from which the extension plate 156 extends may be a base, and the extension plate 156 is replaceable with a suitable support for the bush 140. The return spring 144 forces the return movement of the charging lever 126, and may further be used to force the return movement of the solenoid plunger 118 into the solenoid 116. Tensioning cam 146 is mounted rigidly on the main shaft 130 and the shaft 130 rotates in one direction only, direction 136, in order to prevent the withdrawal of the tensioning cam 146 under the pressure of energy storage springs 148, as shown in FIG. 1. The tensioning cam 146 drives the carriage system 150 via the carriage roller 152. The carriage system 150 is inclusive of the components that are able to transfer force and motion of the tensioning cam 146 to compress the energy storage springs 148. The roller 152 is supported on and rotates about a roller shaft 154 that extends perpendicularly from carriage plate 158. A toggle opening 162 in the carriage plate 158 allows the breaker toggle 114 to pass there through. A spring compressing bar 160 of the carriage system 150 directly compresses the energy storage springs 148.

Figure 6:
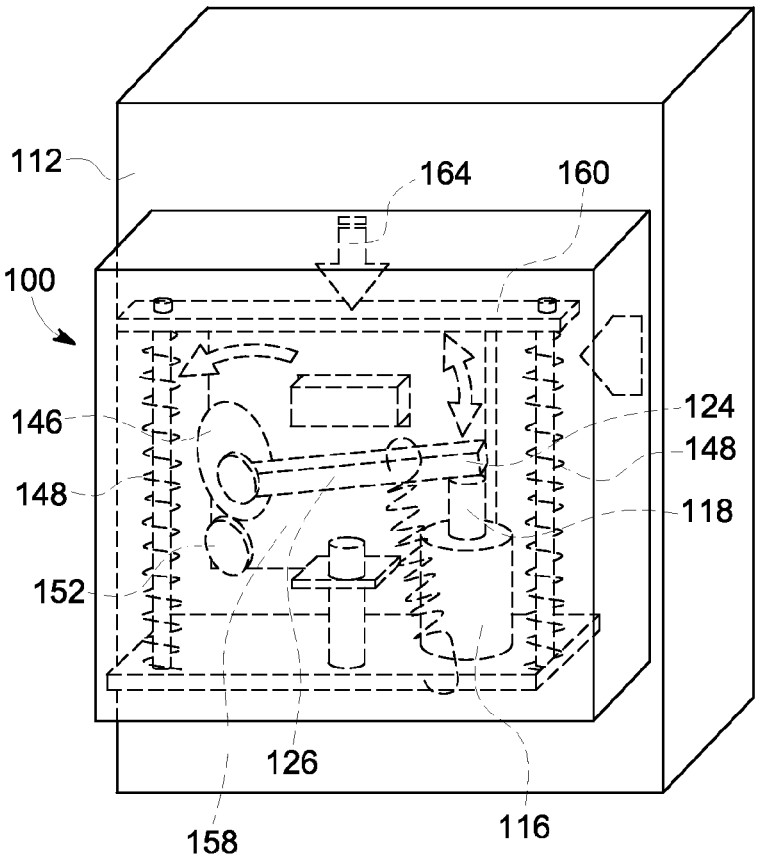
FIG. 6 is a front perspective view of the electrical operator of FIG. 1 in a start position.
Figure 7:
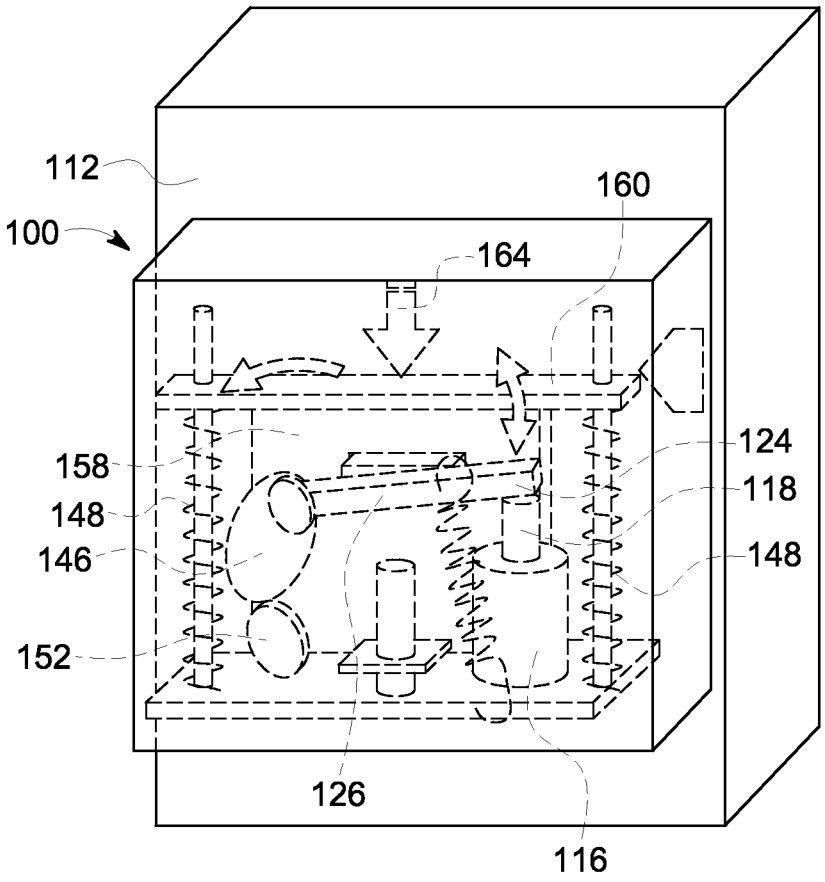
FIG. 7 is a front perspective view of the electrical operator of FIG. 1 in a charging operation.
Figure 8:
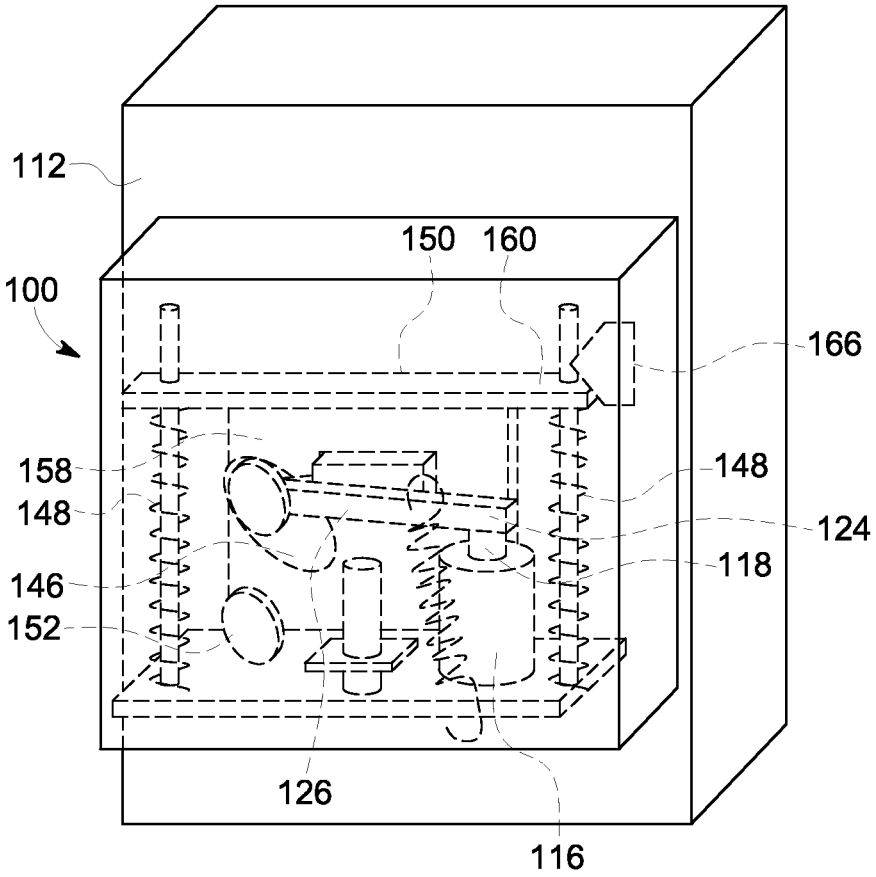
FIG. 8 is a front perspective view of the electrical operator of FIG. 1 in a charged condition.
Figure 9:
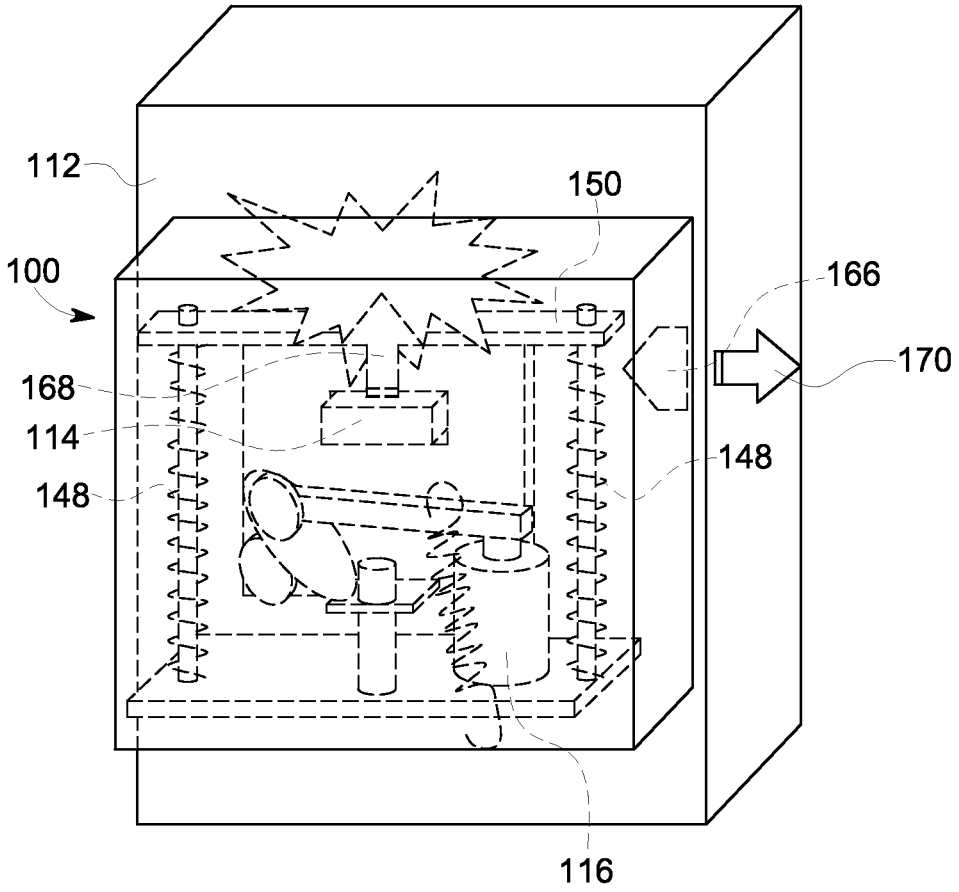
FIG. 9 is a front perspective view of the electrical operator of FIG. 1 in a released condition.

FIGS. 6-9 demonstrate an exemplary operational sequence of the electrical operator 100. As shown in FIG. 6, at the start of a charging operation, an energy storage system, such as one containing the energy storage springs 148, are not yet compressed. The solenoid 116 receives pulsating current and the plunger 118 reciprocates to frequently (repeatedly) push a free end 124 of the charging lever 126, which in turn moves the tensioning cam 146 into engagement with the carriage roller 152 to move the carriage plate 158, that is rigidly connected to the shaft 154 of the carriage roller 152, in a direction 164 that moves the spring compressing bar 160 to compress the energy storage springs 148, as further shown in FIG. 7. At the end of the charging operation, as shown in FIG. 8, the carriage roller 152 drops from the tensioning cam 146, and the carriage system 150 becomes supported with a latching mechanism 166. At the same time, a control system switches the power supply to the solenoid 116 off. As shown in FIG. 9, activating the latching mechanism 166, such as by moving it in direction 170 away from the carriage system 150, causes the carriage system 150 to release. Stored energy from the energy storage springs 148 is transmitted to the circuit breaker toggle 114 in direction 168, via the carriage plate 158, and the breaker 112 is switched substantially instantly.

Figure 10:
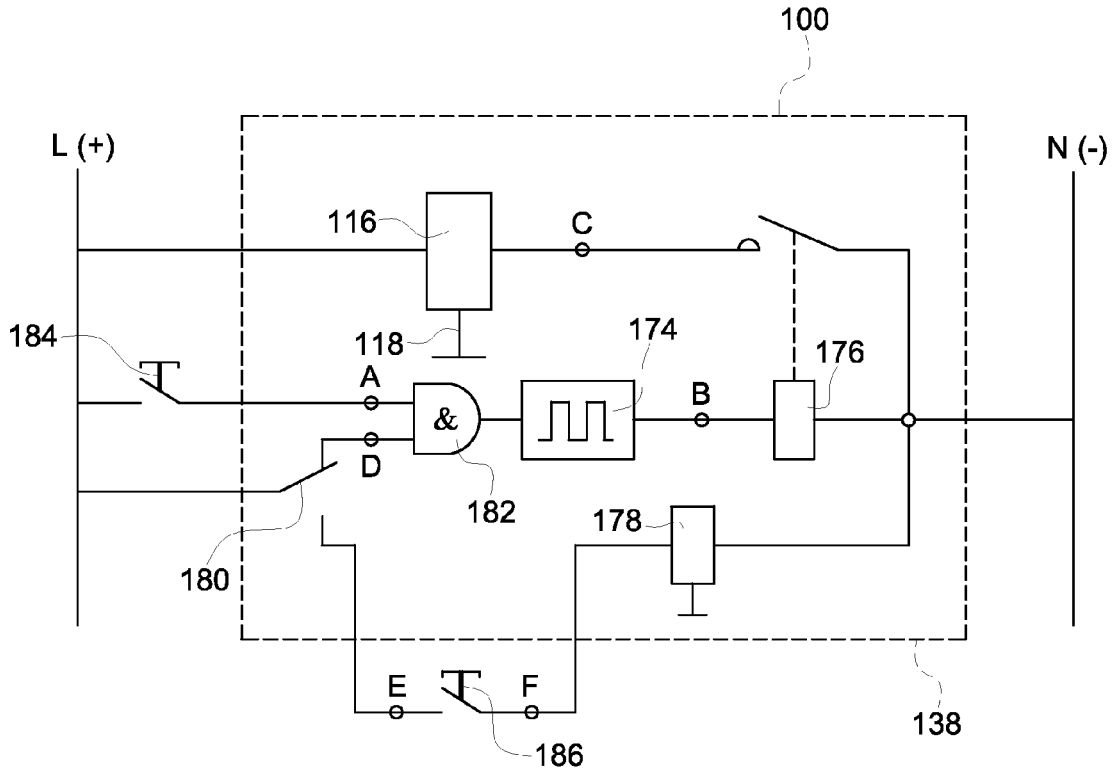
FIG. 10 is an exemplary circuit diagram of the electrical operator of FIG. 1; and, FIG. 11 is an exemplary signal diagram of the electrical operator of FIG. 1.
Figure 11:
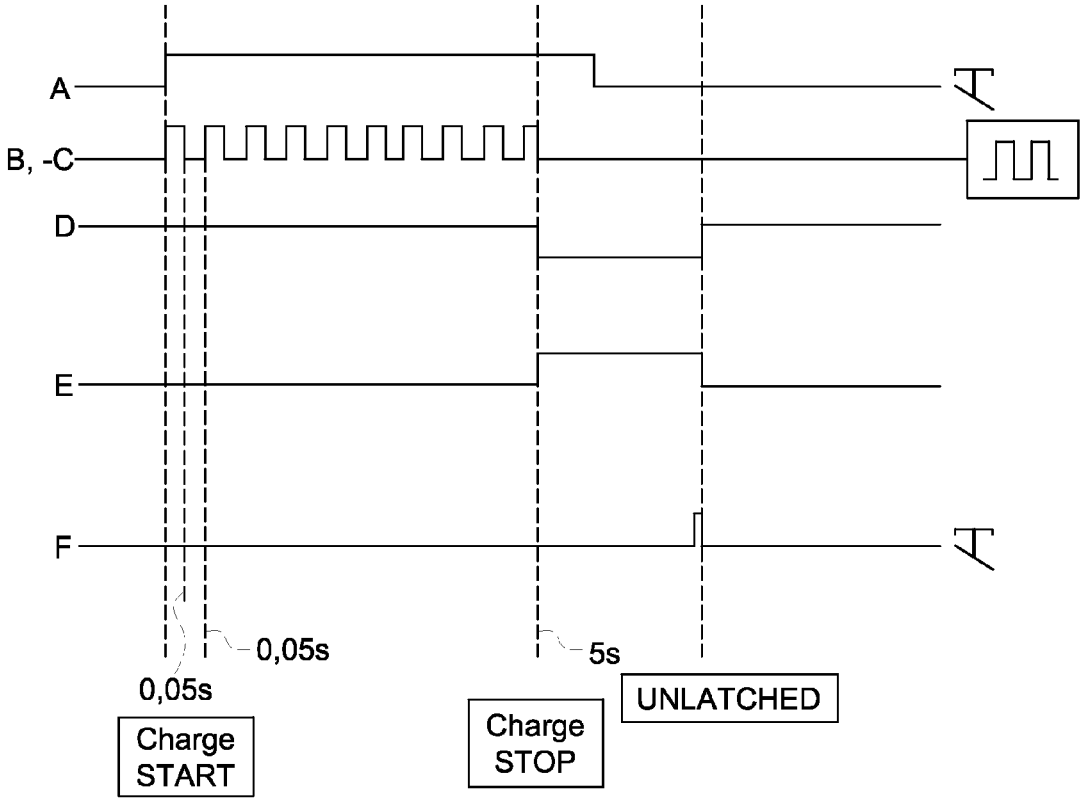

An exemplary embodiment of an electrical diagram of the electrical operator 100 is shown in FIG. 10, and an exemplary signal diagram is shown in FIG. 11. The electrical operator 100 includes the solenoid 116, an impulse voltage generator 174, relay 176, an unlatch actuator 178, a charge operation limit switch 180, and an And operator 182, and includes such elements to operate as an impulse supply system for the electrical operator 100. A housing 138 of the electrical operator 100 also includes an accessible charge pushbutton switch 184 and an unlatch pushbutton switch 186. While certain elements are depicted within the housing 138, it should be understood that certain elements may also be disposed outside of the housing 138, and may also be disposed remotely within an exemplary electrical operator system. With reference to FIG. 10, when the charge pushbutton switch 184 is pushed or otherwise moved to a closed condition, current is provided to point A and the electrical operator 100 begins a charging operation, if not already charged. The impulse voltage generator 174 passes pulsating current at a selected frequency as shown at point B to the relay 176 which in turn passes pulsating current pulses at the selected frequency as shown at point C to the solenoid 116. During a single charging operation, the solenoid 116 reciprocates the solenoid plunger 118 at the frequency of the pulsating current as previously described. During this charging period, the charge operation limit switch 180 directs current to the And operator 182 as shown at point D.

When the operator 100 reaches its charge limit, the charge operation limit switch 180 switches to point E, thus providing current to point E as shown. This indicates a charge stop condition. Without the current from D in the And operator 182, the impulse voltage generator 174 no longer provides the impulses to point B and point C, and thus the solenoid plunger 118 no longer moves with respect to the solenoid 116.

Although the circuit breaker 112 may itself be opened in the event of an over-current condition, the operator 100 is capable of remotely switching the circuit breaker 112, such as, but not limited to, closing the circuit breaker 112. At a time when the circuit breaker 112 is selected to be switched, the unlatch pushbutton switch 186 is pushed which allows current from point E to deliver current to point F which actuates the electrical unlatch actuator 178. As described above, when the electrical unlatch actuator 178 releases the stored energy of the energy storage springs 148, the carriage system 150 is no longer charged and thus the charge operation limit switch 180 reverts to the position shown in FIG. 10 which directs current to point D. However, until the charge pushbutton switch 184 is engaged again, the And operator 182 does not send current to the impulse voltage generator 174 and the operator 100 is not recharged. Thus, the operator 100 is in the unlatched condition shown in FIG. 9. While particular time spans are depicted in FIG. 11 as including a 5 second charging operation using a frequency of 0.05 seconds for each pulse of current, these time spans are only one exemplary embodiment of an operational timing sequence, and other time spans are within the scope of these embodiments. The pulsating current passed from point B to point C illustrates an exemplary plurality of pulses received by the solenoid 116 during a period from Charge START to Charge STOP.

By providing the solenoid 116 as described within the exemplary embodiments of the electrical operator 100, some advantages that may be realized in the practice of some embodiments include the design of the electrical operator 100 being simplified by eliminating complicated gears and motor. Cost may be reduced as a motor is often not fully utilized due to its long lifetime, and is the most expensive and largest element of the operator. The operator 100 may also become more compact and slim as compared to an electrical operator having a motor. A height decrease can allow the reduction of breaker depth inside a cubicle or cabinet. The introduction of an electrically controlled energy storage system charged with a low power solenoid is made possible thanks to usage of the impulse supply system, which can provide small portions of energy via the solenoid 116 to energy storage system over a longer period of time.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An electrical operator for a circuit breaker, the operator comprising:

a housing positionable on an exterior of the circuit breaker, the housing configured to receive a breaker toggle of the circuit breaker;

a carriage system disposed within the housing;

a carriage moving assembly disposed within the housing, the carriage moving assembly operable to move the carriage system; and, a solenoid disposed within the housing arranged to receive a pulsating current, the solenoid having a coil and a plunger within the coil, the plunger configured to repeatedly reciprocate with respect to the coil in response to the pulsating current and thereby actuate the carriage moving assembly;

wherein a portion of the carriage system is configured to allow passage of the breaker toggle into the housing, the portion of the carriage system engageable with the breaker toggle to move the breaker toggle in opposing directions in response to movement of the carriage system.

2. The electrical operator of claim 1, further comprising an impulse voltage generator configured to provide the pulsating, current.

3. The electrical operator of claim 2, further comprising a charge switch, wherein current is delivered to the impulse voltage generator when the charge switch is closed.

4. The electrical operator of claim 3, further comprising a limit switch configured to prevent delivery of the pulsating current to the solenoid.

5. The electrical operator of claim 4, further comprising a latching mechanism, an unlatch switch, and an unlatch actuator, wherein the latching mechanism is configured to latch the carriage system when at least one energy storage spring is energized, the unlatch switch is configured to deliver current to actuate the unlatch actuator when the unlatch switch is closed, and the unlatch actuator is configured to actuate the latching mechanism to transmit stored energy from the at least one energy storage spring to the carriage system and breaker toggle.

6. The electrical operator of claim 1, wherein the carriage moving assembly includes a charging lever, the plunger arranged to engage the charging lever at a frequency of the pulsating current.

7. The electrical operator of claim 6, wherein the charging lever is configured to be engaged by the plunger multiple times during a single charging operation of the electrical operator.

8. The electrical operator of claim 6, further comprising a return spring, the charging lever biased by the return spring towards the plunger.

9. The electrical operator of claim 6, wherein the carriage system includes a carriage plate including a toggle opening for receipt of the breaker toggle, the carriage plate movable to engage the breaker toggle, and the charging lever extends in a direction substantially parallel to the carriage plate.

10. The electrical operator of claim 1, wherein the carriage moving assembly includes a tensioning cam arranged to engage the carriage system and drive the carriage system in response to the pulsating current.

11. The electrical operator of claim 10, wherein the carriage moving assembly further includes a main shaft connected to the tensioning cam, and a charging lever having a free end and a pivot end, the pivot end supported on the main shaft, and the plunger arranged to engage the free end of the charging lever at a frequency of the pulsating current.

12. The electrical operator of claim 1, wherein the carriage system includes a carriage plate, a roller shaft that extends from the carriage plate, and a carriage roller mounted on and rotatable about the roller shaft.

13. The electrical operator of claim 1, wherein the carriage system includes a carriage plate having a toggle opening, sized for passage of the breaker toggle, and the toggle opening is configured to transmit movement of the carriage system to the breaker toggle.

14. An electrical operator for a circuit breaker, the operator comprising:

a housing positionable on an exterior of the circuit breaker, the housing configured to receive a breaker toggle of the circuit breaker;

a carriage system disposed within the housing and engageable with the breaker toggle of the circuit breaker;

a carriage moving assembly arranged within the housing to move the carriage system, the carriage moving assembly operable to move the carriage system; and, a solenoid disposed within the housing arranged to receive a pulsating current and including a coil and a plunger within the coil, the plunger arranged to repeatedly reciprocate with respect to the coil in response to the pulsating current and thereby actuate the carriage moving assembly;

wherein a portion of the carriage system is configured to allow passage of the breaker toggle into the housing, the portion of the carriage system engageable with the breaker toggle to move the breaker toggle in opposing directions in response to movement of the carriage system.

15. The electrical operator of claim 14, further comprising an impulse voltage generator arranged to provide the pulsating current.

16. The electrical operator of claim 15, further comprising a charge switch, wherein the charge switch delivers current to the impulse voltage generator when closed.

17. The electrical operator of claim 14, wherein the carriage moving assembly includes a charging lever, the plunger arranged to engage the charging lever at a frequency of the pulsating current.

18. A method of operating an electrical operator mounted to an exterior of a circuit breaker, the method comprising:

passing a breaker toggle through a portion Of a carriage system of the electrical operator;

closing a switch of the electrical operator;

delivering a pulsating current to a solenoid within the electrical operator;

reciprocating a plunger of the solenoid at a frequency of the pulsating current;

engaging the plunger with a carriage moving assembly, the carriage moving assembly moving the carriage system to compress energy storage springs;

engaging the breaker toggle with the carriage system during compression of the energy storage springs; and, latching the carriage system.

19. The method of claim 18, further comprising unlatching the carriage system to switch the circuit breaker.

20. The method of claim 18, wherein engaging the plunger with the carriage moving assembly comprises engaging a charging lever of the carriage moving assembly with the plunger multiple times during a single charging operation.

* * * * *